US008499857B2

(12) United States Patent
Hall et al.

(10) Patent No.: US 8,499,857 B2
(45) Date of Patent: Aug. 6, 2013

(54) DOWNHOLE JACK ASSEMBLY SENSOR

(75) Inventors: David R. Hall, Provo, UT (US); David Lundgreen, Provo, UT (US); Jim Shumway, Lehi, UT (US); Nathan Nelson, Provo, UT (US); Daryl Wise, Provo, UT (US); Paula Turner, Pleasant Grove, UT (US)

(73) Assignee: Schlumberger Technology Corporation, Houston, TX (US)

( * ) Notice: Subject to any disclaimer, the term of this patent is extended or adjusted under 35 U.S.C. 154(b) by 45 days.

(21) Appl. No.: 12/623,566

(22) Filed: Nov. 23, 2009

(65) Prior Publication Data

US 2010/0108385 A1 May 6, 2010

Related U.S. Application Data

(63) Continuation of application No. 11/851,094, filed on Sep. 6, 2007, now Pat. No. 7,721,826.

(51) Int. Cl.
*E21B 10/26* (2006.01)

(52) U.S. Cl.
USPC ..... 175/73; 175/385

(58) Field of Classification Search
USPC ..... 175/408, 415, 95, 107, 333, 73, 74, 175/322, 385
See application file for complete search history.

(56) References Cited

U.S. PATENT DOCUMENTS 616,118 A 12/1889 Kunhe
465,103 A 12/1891 Wegner
572,735 A 12/1896 Thompson
923,513 A 6/1909 Hardsocg
946,060 A 1/1910 Looker
1,116,154 A 11/1914 Stowers
1,183,630 A 5/1916 Bryson
1,189,560 A 7/1916 Gondos
1,360,908 A 11/1920 Everson
1,372,257 A 3/1921 Swisher
1,387,733 A 8/1921 Midgett
1,460,671 A 7/1923 Hebsacker
1,544,757 A 7/1925 Hufford
1,619,328 A 3/1927 Benckenstein
1,746,455 A 2/1930 Woodruff et al.
1,746,456 A 2/1930 Allington (Continued)

OTHER PUBLICATIONS

Patent Cooperation Treaty, International Search Report and Written Opinion of the International Searching Authority for PCT/US07/64544, date of mailing Aug. 5, 2008.

(Continued)

*Primary Examiner* — Shane Bomar
*Assistant Examiner* — Kipp Wallace
(74) *Attorney, Agent, or Firm* — Brinks Hofer Gilson & Lione

(57) ABSTRACT

A drilling apparatus which includes a drill bit attachable to the drilling end of a drill string, the drill bit including a bit body being attached to a shank and having a working face with at least one cutting element. The drilling apparatus also includes a jack element positioned within a bore of the bit body having a working tip substantially protruding from the working face, and which jack element is also adapted to move with respect to the bit body. One or more position feedback sensors are positioned proximate the jack element and are adapted to detect the axial and/or angular position of the jack element with respect to the bit body.

21 Claims, 11 Drawing Sheets

U.S. PATENT DOCUMENTS 2,169,223 A 8/1931 Christian
1,821,474 A 9/1931 Mercer
1,836,638 A 12/1931 Wright et al.
1,879,177 A 9/1932 Gault
2,022,101 A 11/1935 Wright
2,054,255 A 9/1936 Howard
2,064,255 A 12/1936 Garfield
2,100,692 A 11/1937 Harman
2,102,236 A 12/1937 Johansen
2,196,940 A 4/1940 Potts
2,199,692 A 5/1940 Catland
2,218,130 A 10/1940 Court
2,227,233 A 12/1940 Scott et al.
2,249,769 A 7/1941 Leonardon
2,300,016 A 10/1942 Scott et al.
2,320,136 A 5/1943 Kammerer
2,345,024 A 3/1944 Bannister
2,371,248 A 3/1945 McNamara
2,375,335 A 5/1945 Walker
2,466,991 A 4/1949 Kammerer
2,498,192 A 2/1950 Wright
2,540,464 A 2/1951 Stokes
2,544,036 A 3/1951 Kammerer
2,575,173 A 11/1951 Johnson
2,578,593 A 12/1951 Phipps
2,619,325 A 1/1952 Arutunoff
2,626,780 A 1/1953 Ortloff
2,643,860 A 6/1953 Koch
2,725,215 A 11/1955 Macneir
2,735,653 A 2/1956 Bielstein
2,746,721 A 5/1956 Moore
2,755,071 A 7/1956 Kammerer
2,776,819 A 1/1957 Brown
2,807,443 A 9/1957 Wyman
2,815,932 A 12/1957 Wolfram
2,819,041 A 1/1958 Beckham
2,819,043 A 1/1958 Henderson
2,838,284 A 6/1958 Austin
2,868,511 A 1/1959 Barrett
2,873,093 A 2/1959 Hildebrandt et al.
2,877,984 A 3/1959 Causey
2,894,722 A 7/1959 Buttolph
2,901,223 A 8/1959 Scott
2,917,704 A 12/1959 Arps
2,942,850 A 6/1960 Heath
2,942,851 A 6/1960 Beck
2,963,102 A 12/1960 Smith
2,998,085 A 8/1961 Dulaney
3,036,645 A 5/1962 Rowley
3,055,443 A 9/1962 Edwards
3,058,532 A 10/1962 Alder
3,059,708 A 10/1962 Cannon et al.
3,075,592 A 1/1963 Overly et al.
3,077,936 A 2/1963 Arutunoff
3,105,560 A 10/1963 Zublin
3,135,341 A 6/1964 Ritter
3,139,147 A 6/1964 Hays et al.
3,163,243 A 12/1964 Cleary
3,199,617 A 8/1965 White
3,216,514 A 11/1965 Nelson
3,251,424 A 5/1966 Brooks
3,274,798 A 9/1966 Wiggins, Jr.
3,294,186 A 12/1966 Buell
3,301,339 A 1/1967 Pennebaker
3,303,899 A 2/1967 Jones et al.
3,319,147 A 5/1967 Mapham
3,336,988 A 8/1967 Jones
3,346,060 A 10/1967 Beyer
3,379,264 A 4/1968 Cox
3,387,673 A 6/1968 Thompson
3,429,390 A 2/1969 Bennett
3,433,331 A 3/1969 Heyberger
3,455,158 A 7/1969 Richter et al.
3,493,165 A 2/1970 Schonfeld
3,583,504 A 6/1971 Aalund
3,635,296 A 1/1972 Lebourg
3,667,556 A 6/1972 Henderson
3,688,852 A 9/1972 Gaylord
3,700,049 A 10/1972 Tiraspolsky et al.
3,732,143 A 5/1973 Joosse
3,764,493 A 10/1973 Rosar
3,807,512 A 4/1974 Pogonowski et al.
3,815,692 A 6/1974 Varley
3,821,993 A 7/1974 Kniff
3,885,638 A 5/1975 Skidmore et al.
3,899,033 A 8/1975 Huisen
3,955,635 A 5/1976 Skidmore
3,960,223 A 6/1976 Kleine
3,978,931 A 9/1976 Sudnishnikov et al.
3,989,114 A 11/1976 Tschirky
4,081,042 A 3/1978 Johnson
4,096,917 A 6/1978 Harris
4,106,577 A 8/1978 Summers
4,109,737 A 8/1978 Bovenkerk
4,165,790 A 8/1979 Emmerich
4,176,723 A 12/1979 Arceneaux
4,207,964 A 6/1980 Taguchi
4,253,533 A 3/1981 Baker
4,262,758 A 4/1981 Evans
4,280,573 A 7/1981 Sudnishnikov
4,304,312 A 12/1981 Larsson
4,307,786 A 12/1981 Evans
4,386,669 A 6/1983 Evans
4,397,361 A 8/1983 Langford
4,416,339 A 11/1983 Baker
4,445,580 A 5/1984 Sahley
4,448,269 A 5/1984 Ishikawa
4,478,295 A 10/1984 Evans
4,478,296 A 10/1984 Richman
4,499,795 A 2/1985 Radtke
4,531,592 A 7/1985 Hayatdavoudi
4,533,004 A 8/1985 Ecer
4,535,853 A 8/1985 Ippolito
4,538,691 A 9/1985 Dennis
4,566,545 A 1/1986 Story
4,574,895 A 3/1986 Dolezal
4,583,592 A 4/1986 Gazda et al.
4,592,432 A 6/1986 Williams et al.
4,597,454 A 7/1986 Schoeffler
4,612,987 A 9/1986 Cheek
4,615,399 A 10/1986 Schoeffler
4,624,306 A 11/1986 Traver et al.
4,637,479 A 1/1987 Leising
4,640,374 A 2/1987 Dennis
4,679,637 A 7/1987 Cherrington
4,683,781 A 8/1987 Kar et al.
4,694,913 A 9/1987 McDonald et al.
4,732,223 A 3/1988 Schoeffler
4,732,226 A 3/1988 Ebeling et al.
4,733,734 A 3/1988 Bardin et al.
4,775,017 A 10/1988 Forrest et al.
4,817,739 A 4/1989 Jeter
4,819,745 A 4/1989 Walter
4,821,819 A 4/1989 Whysong
4,830,122 A 5/1989 Walter
4,836,301 A 6/1989 Van Dongen et al.
4,852,672 A 8/1989 Behrens
4,858,706 A 8/1989 Lebourgh
4,875,531 A 10/1989 Biehl
4,889,017 A 12/1989 Fuller
4,889,199 A 12/1989 Lee
4,899,835 A 2/1990 Cherrington
4,907,665 A 3/1990 Kar et al.
4,938,297 A 7/1990 Schmidt
4,962,822 A 10/1990 Pascale
4,974,688 A 12/1990 Helton
4,979,577 A 12/1990 Walter
4,981,184 A 1/1991 Knowlton
4,991,667 A 2/1991 Wilkes et al.
4,991,670 A 2/1991 Fuller
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,094,304 A 3/1992 Briggs
5,099,927 A 3/1992 Gibson et al.

5,103,919 A 4/1992 Warren et al.
5,112,188 A 5/1992 Barnetche-Gonzalez
5,119,892 A 6/1992 Clegg
5,135,060 A 8/1992 Ide
5,141,063 A 8/1992 Quesenbury
5,148,875 A 9/1992 Karlsson et al.
5,163,520 A 11/1992 Gibson et al.
5,176,212 A 1/1993 Tandberg
5,186,268 A 2/1993 Clegg
5,193,628 A 3/1993 Hill et al.
5,222,566 A 6/1993 Taylor
5,255,749 A 10/1993 Bumpurs
5,259,469 A 11/1993 Stjernstrom et al.
5,265,682 A 11/1993 Russell
5,277,373 A * 1/1994 Morton ..... 242/413.5
5,311,953 A 5/1994 Walker
5,314,030 A 5/1994 Peterson et al.
5,339,037 A 8/1994 Bonner et al.
5,361,859 A 11/1994 Tibbitts
5,388,649 A 2/1995 Ilomaki
5,410,303 A 4/1995 Comeau
5,415,030 A 5/1995 Jogi et al.
5,417,292 A 5/1995 Polakoff
5,423,389 A 6/1995 Warren
5,442,294 A 8/1995 Rorden
5,443,128 A 8/1995 Amaudric du Chaffaut
5,475,309 A 12/1995 Hong et al.
5,507,357 A 4/1996 Hult
5,547,032 A 8/1996 Wenzel
5,553,678 A 9/1996 Barr et al.
5,560,440 A 10/1996 Tibbitts
5,568,838 A 10/1996 Struthers
5,642,782 A 7/1997 Grimshaw
5,655,614 A 8/1997 Azar
5,678,644 A 10/1997 Fielder
5,720,355 A 2/1998 Lamine et al.
5,732,784 A 3/1998 Nelson
5,758,731 A 6/1998 Zollinger
5,758,732 A 6/1998 Liw
5,778,991 A 7/1998 Runquist et al.
5,794,728 A 8/1998 Palmberg
5,806,611 A 9/1998 Van Den Steen
5,833,021 A 11/1998 Mensa-Wilmot et al.
5,848,657 A 12/1998 Flood
5,864,058 A 1/1999 Chen
5,896,938 A 4/1999 Moeny
5,901,113 A 5/1999 Masak et al.
5,901,796 A 5/1999 McDonald
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,589 A 2/2000 Cagliari et al.
6,021,859 A 2/2000 Tibbitts
6,039,131 A 3/2000 Beaton
6,047,239 A 4/2000 Berger et al.
6,050,350 A 4/2000 Morris et al.
6,057,784 A 5/2000 Schaaf et al.
6,089,332 A 7/2000 Barr et al.
6,092,610 A 7/2000 Kosmala et al.
6,131,675 A 10/2000 Anderson
6,150,822 A 11/2000 Hong
6,161,631 A 12/2000 Kennedy et al.
6,186,251 B1 2/2001 Butcher
6,199,956 B1 3/2001 Kammerer
6,202,761 B1 3/2001 Forney
6,213,225 B1 4/2001 Chen
6,213,226 B1 4/2001 Eppink
6,223,824 B1 5/2001 Moyes
6,253,864 B1 7/2001 Hall
6,269,893 B1 8/2001 Beaton
6,296,069 B1 10/2001 Lamine
6,298,930 B1 10/2001 Sinor
6,321,858 B1 11/2001 Wentworth et al.
6,325,163 B2 12/2001 Tibbitts
6,332,503 B1 12/2001 Pessier
6,338,390 B1 1/2002 Tibbitts
6,340,064 B2 1/2002 Fielder
6,363,780 B1 4/2002 Rey-Fabret
6,364,034 B1 4/2002 Schoeffler
6,364,038 B1 4/2002 Driver
6,394,200 B1 5/2002 Watson
6,408,959 B2 6/2002 Bertagnolli
6,415,687 B2 7/2002 Saxman
6,439,326 B1 8/2002 Huang
6,443,249 B2 9/2002 Beuershausen
6,450,269 B1 9/2002 Wentworth et al.
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,484,826 B1 11/2002 Anderson et al.
6,502,650 B1 1/2003 Beccu
6,508,317 B2 1/2003 Eddison
6,510,906 B1 1/2003 Richert
6,513,606 B1 2/2003 Krueger
6,533,050 B2 3/2003 Malloy
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Bolnan
6,601,662 B2 8/2003 Matthias et al.
6,622,803 B2 9/2003 Harvey
6,652,202 B2 11/2003 Remke
6,668,949 B1 12/2003 Rives
6,670,880 B1 12/2003 Hall et al.
6,672,406 B2 1/2004 Beuershausen
6,684,967 B2 2/2004 Mensa-Wilmot
6,698,537 B2 3/2004 Pascale
6,702,393 B2 3/2004 Mercier
6,729,420 B2 5/2004 Mensa-Wilmot
6,732,817 B2 5/2004 Dewey
6,733,087 B2 5/2004 Hall et al.
6,749,031 B2 6/2004 Klemm
6,789,635 B2 9/2004 Wentworth et al.
D496,948 S 10/2004 Charland et al.
6,814,162 B2 11/2004 Moran et al.
6,820,697 B1 11/2004 Churchill
6,822,579 B2 11/2004 Goswani
6,850,068 B2 2/2005 Chemali et al.
6,880,648 B2 4/2005 Edscer
6,913,095 B2 7/2005 Krueger
6,929,076 B2 8/2005 Fanuel
6,948,572 B2 9/2005 Hay et al.
6,953,096 B2 10/2005 Glenhill
6,991,049 B2 1/2006 Eyre et al.
6,994,175 B2 2/2006 Egerstrom
7,013,994 B2 3/2006 Eddison
7,021,404 B2 4/2006 Fanuel
7,025,155 B1 4/2006 Estes
7,073,610 B2 7/2006 Susman
7,095,233 B1 8/2006 Tabanou et al.
7,096,980 B2 8/2006 Trevas
7,104,344 B2 9/2006 Kriesels
7,118,181 B2 10/2006 Frear
7,198,119 B1 4/2007 Hall et al.
7,204,560 B2 4/2007 Mercier et al.
7,207,398 B2 4/2007 Runia
7,225,886 B1 6/2007 Hall
7,240,744 B1 7/2007 Kemick
7,258,179 B2 8/2007 Hall
7,270,196 B2 9/2007 Hall
7,281,584 B2 10/2007 McGarian et al.
7,303,007 B2 12/2007 Konschuh
7,328,755 B2 2/2008 Hall et al.
7,337,858 B2 3/2008 Hall et al.
D566,137 S 4/2008 Hall et al.
7,360,610 B2 4/2008 Hall et al.
7,360,612 B2 4/2008 Chen et al.

| | | | |
|---|---|---|---|
| 7,367,397 | B2 | 5/2008 | Clemens et al. |
| D572,735 | S | 7/2008 | Kammerer |
| 7,398,837 | B2 | 7/2008 | Hall et al. |
| 7,419,016 | B2 | 9/2008 | Hall et al. |
| 7,419,018 | B2 | 9/2008 | Hall et al. |
| 7,424,922 | B2 | 9/2008 | Hall et al. |
| 7,426,968 | B2 | 9/2008 | Hall et al. |
| 7,461,709 | B2 | 12/2008 | Keshavan et al. |
| 7,481,281 | B2 | 1/2009 | Schuaf |
| 7,484,576 | B2 | 2/2009 | Hall et al. |
| 7,497,279 | B2 | 3/2009 | Hall et al. |
| 7,503,405 | B2 | 3/2009 | Hall et al. |
| 7,506,701 | B2 | 3/2009 | Hall et al. |
| 7,506,706 | B2 | 3/2009 | Hall |
| 7,510,031 | B2 | 3/2009 | Russell et al. |
| 7,533,737 | B2 | 5/2009 | Hall |
| 7,533,740 | B2 | 5/2009 | Zhang et al. |
| 7,549,489 | B2 | 6/2009 | Hall et al. |
| 7,559,379 | B2 | 7/2009 | Hall et al. |
| 7,571,780 | B2 | 8/2009 | Hall et al. |
| 7,591,327 | B2 | 9/2009 | Hall |
| 7,600,586 | B2 | 10/2009 | Hall et al. |
| 7,617,886 | B2 | 11/2009 | Hall |
| 7,624,824 | B2 | 12/2009 | Hall et al. |
| 7,641,002 | B2 | 1/2010 | Hall et al. |
| 7,641,003 | B2 | 1/2010 | Hall et al. |
| 7,661,487 | B2 | 2/2010 | Hall et al. |
| 7,694,756 | B2 | 4/2010 | Hall et al. |
| 7,798,256 | B2 | 9/2010 | Hoffmaster |
| 7,836,948 | B2 | 11/2010 | Kusko et al. |
| 2001/0004946 | A1 | 6/2001 | Jensen |
| 2001/0007290 | A1 | 7/2001 | Saxman |
| 2001/0031178 | A1 | 10/2001 | Remke |
| 2001/0054515 | A1 | 12/2001 | Eddison et al. |
| 2002/0050359 | A1 | 5/2002 | Eddison |
| 2002/0079139 | A1 | 6/2002 | Mensa-Wilmot |
| 2002/0079140 | A1 | 6/2002 | Eyre et al. |
| 2002/0175555 | A1 | 11/2002 | Mercier |
| 2003/0209366 | A1 | 11/2003 | McAlvain |
| 2003/0213621 | A1 | 11/2003 | Britten |
| 2004/0026132 | A1 | 2/2004 | Hall et al. |
| 2004/0065484 | A1 | 4/2004 | McAlvain |
| 2004/0154839 | A1 | 8/2004 | McGarian et al. |
| 2004/0173381 | A1 | 9/2004 | Moore et al. |
| 2004/0222024 | A1 | 11/2004 | Edscer |
| 2004/0238221 | A1 * | 12/2004 | Runia et al. ..... 175/61 |
| 2004/0256155 | A1 | 12/2004 | Kriesels |
| 2005/0082093 | A1 | 4/2005 | Keshavan et al. |
| 2005/0211471 | A1 | 9/2005 | Zupanick |
| 2006/0016606 | A1 | 1/2006 | Tubel et al. |
| 2006/0033379 | A1 | 2/2006 | Frear |
| 2006/0117759 | A1 | 6/2006 | Hall et al. |
| 2006/0196699 | A1 | 9/2006 | Estes et al. |
| 2006/0207802 | A1 | 9/2006 | Zhang et al. |
| 2006/0243493 | A1 | 11/2006 | El-Rayes et al. |
| 2006/0260797 | A1 | 11/2006 | Hall et al. |
| 2006/0260798 | A1 | 11/2006 | Hall et al. |
| 2006/0283640 | A1 | 12/2006 | Estes et al. |
| 2007/0017671 | A1 | 1/2007 | Clark et al. |
| 2007/0029116 | A1 | 2/2007 | Keshavan |
| 2007/0079988 | A1 | 4/2007 | Konschuh et al. |
| 2007/0114067 | A1 | 5/2007 | Hall |
| 2007/0114068 | A1 | 5/2007 | Hall et al. |
| 2007/0119630 | A1 | 5/2007 | Hall et al. |
| 2007/0151732 | A1 | 7/2007 | Clemens et al. |
| 2007/0205023 | A1 | 9/2007 | Hoffmaster et al. |
| 2007/0221417 | A1 | 9/2007 | Hall et al. |
| 2007/0272448 | A1 | 11/2007 | Griffo |
| 2007/0277651 | A1 | 12/2007 | Calnan |
| 2008/0006448 | A1 | 1/2008 | Zhang |
| 2008/0011521 | A1 | 1/2008 | Hall et al. |
| 2008/0029312 | A1 | 2/2008 | Hall et al. |
| 2008/0073126 | A1 | 3/2008 | Shen et al. |
| 2008/0230278 | A9 | 9/2008 | Hoffmaster et al. |
| 2008/0296015 | A1 | 12/2008 | Hall et al. |
| 2009/0260984 | A1 | 10/2009 | Raj |
| 2010/0000799 | A1 | 1/2010 | Hall |
| 2010/0065334 | A1 | 3/2010 | Hall |

OTHER PUBLICATIONS

Paten Cooperation Treaty, International Preliminary Report on Patentability, International Search Report and Written Opinion of the International Searching Authority for PCT/US06/43107, date of mailing Mar. 5, 2007.

Paten Cooperation Treaty, International Preliminary Report on Patentability and Written Opinion of the International Searching Authority for PCT/US06/43125, date of mailing Jun. 4, 2007; and the International Search Report, dated Feb. 23, 2007.

PCT/US06/43125 International Search Report; Written Opinion, May 27, 2008.

PCT/US07/64539, International Search Report and Written Opinion, Jun. 16, 2008.

PCT International Application Status Report, Sep. 1, 2007.

Bonner, Steve, et al., "Measurements at the Bit: A New Generation of MWD Tools," Oilfield Review, pp. 44-54 (Apr./Jul. 1993).

Ocean Drilling Program (ODP) Logging Services, "Logging-While-Drilling Resistivity-at-Bit Tool," Lamont-Doherty Earth Observatory, Palisades, NY, 2 pages (Dec. 2003).

PCT International Preliminary Report on Patentability Chapter 1 for PCT/US07/64544, mailed Sep. 30, 2008.

* cited by examiner

DOWNHOLE JACK ASSEMBLY SENSOR

This application is a continuation of U.S. patent application Ser. No. 11/851,094, filed Sep. 6, 2007, now U.S. Pat. No. 7,721,826, which is herein incorporated by reference for all that it discloses.

FIELD OF THE INVENTION

The present invention relates to the field of downhole oil, gas, and geothermal exploration and drilling, and more particularly to the field of drill bits for aiding such exploration and drilling.

BACKGROUND OF THE INVENTION

Drill bits use rotary energy provided by a drill string to cut through downhole formations, thus advancing the drill string further into the ground. To use drilling time effectively, sensors have been placed in the drill string, usually in a bottom-hole assembly found in the lower end of the drill string, to assist the operator in making drilling decisions. In the patent prior art, equipment and methods of conveying and interpreting sensory data obtained from downhole have been disclosed.

For example, U.S. Pat. No. 6,150,822 to Hong, et al., which is herein incorporated by reference for all that it contains, discloses a microwave frequency range sensor (antenna or wave guide) disposed in the face of a diamond or PDC drill bit configured to minimize invasion of drilling fluid into the formation ahead of the bit. The sensor is connected to an instrument disposed in a sub interposed in the drill stem for generating and measuring the alteration of microwave energy.

U.S. Pat. No. 6,814,162 to Moran, et al., which is herein incorporated by reference for all that it contains, discloses a drill bit, comprising a bit body, a sensor disposed in the bit body, a single journal removably mounted to the bit body, and a roller cone rotatably mounted to the single journal. The drill bit may also comprise a short-hop telemetry transmission device adapted to transmit data from the sensor to a measurement-while-drilling device located above the drill bit on the drill string.

U.S. Pat. No. 5,415,030 to Jogi, et al., which is herein incorporated by reference for all that it contains, discloses a method for evaluating formations and bit conditions. The invention processes signals indicative of downhole weight on bit (WOB), downhole torque (TOR), rate of penetration (ROP), and bit rotations (RPM), while taking into account bit geometry to provide a plurality of well logs and to optimize the drilling process.

U.S. Pat. No. 5,363,926 to Mizuno, which is herein incorporated by reference for all that it contains, discloses a device for detecting inclination of a boring head of a boring tool.

The prior art also discloses devices adapted to steer the direction of penetration of a drill string. U.S. Pat. Nos. 6,913,095 to Krueger, 6,092,610 to Kosmala, et al., 6,581,699 to Chen, et al., 2,498,192 to Wright, 6,749,031 to Klemm, 7,013,994 to Eddison, which are all herein incorporated by reference for all that they contain, discloses directional drilling systems.

BRIEF SUMMARY OF THE INVENTION

In one aspect of the invention, a drilling apparatus includes a drill bit attachable to the drilling end of a drill string, the drill bit having a bit body attached to a shank and a working face with at least one cutting element. The drilling apparatus further includes a jack element positioned within a bore of the bit body and having a working tip substantially protruding from the working face and which jack element is also adapted to move with respect to the bit body. One or more position feedback sensors are positioned proximate the jack element and are adapted to detect the axial or angular position of the jack element with respect to the bit body. The position feedback sensors may also be adapted to calculate a velocity of the jack element.

The jack element may be adapted to rotate about a central axis and it may be adapted to translate along the central axis. Movement of the jack element may be powered by a downhole motor. The jack element may comprise a distal deflecting surface having an angle relative to the central axis of 15 to 75 degrees. The jack assembly may comprise a driving shaft disposed intermediate a driving mechanism and the jack element. In some embodiments a geartrain may be disposed intermediate the driving mechanism and the driving shaft in the jack assembly. A position feedback sensor may be disposed within the geartrain, and it may be disposed proximate other components of the jack assembly.

The position feedback sensor may be in electrical communication with a downhole network. The feedback sensor may be powered by a downhole power source and may be part of a bottom hole assembly. The drill string may include a plurality of position feedback sensors for detecting both the axial and angular position of the jack element with respect to the bit body. Position feedback sensors or a plurality thereof may comprise a hall-effect sensor, an optical encoder, a magnet, a mechanical switch, a slide switch, a resolver, an accelerometer, or combinations thereof. Position feedback sensors may sense the position and/or orientation of the jack element by recognizing a characteristic of a signal element disposed proximate the sensor. The characteristic may comprise a change in density, geometry, length, chemical composition, magnetism, conductivity, optical reactivity, opacity, reflectivity, surface coating composition, or combinations thereof. The signal element may be a sprocket that is disposed on the jack assembly and is mechanically coupled to the jack element.

The drill string may comprise at least one electrical component selected from the group consisting of direction and inclination packages, generators, motors, steering boards, and combinations thereof. The at least one electrical component may be rotationally fixed to the drill string. In some embodiments at least one electrical component may rotationally coupled with respect to the jack element.

DETAILED DESCRIPTION OF EXEMPLARY EMBODIMENTS

Figure 1:
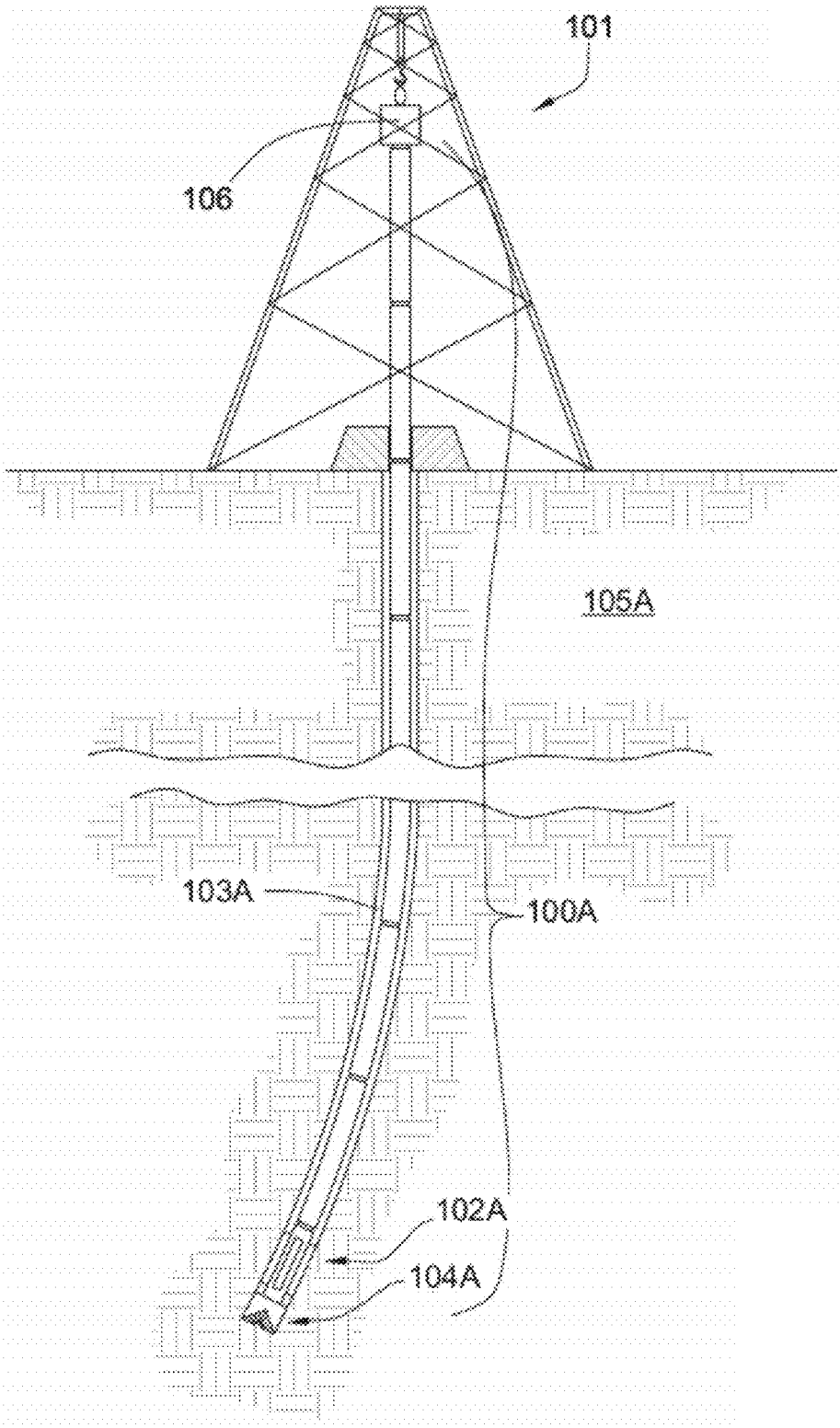
FIG. 1 is an schematic illustration of an embodiment of drill string suspended in a wellbore.

FIG. 1 is a perspective diagram of an embodiment of a drill string 100A suspended by a derrick 101. A bottom-hole assembly 102A is located at the bottom of a wellbore 103A and comprises a drill bit 104A. As the drill bit 104A rotates downhole the drill string 100A advances farther into the earth. The drill string 100A may penetrate soft or hard subterranean formations 105A. The drill bit 104A may be adapted to steer the drill string 100A in a desired trajectory. Steering may be controlled by rotating a jack element (see FIG. 2) that is disposed at least partially within the drill bit 104A around a central axis of the jack element. The bottom-hole assembly 102A and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102A. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
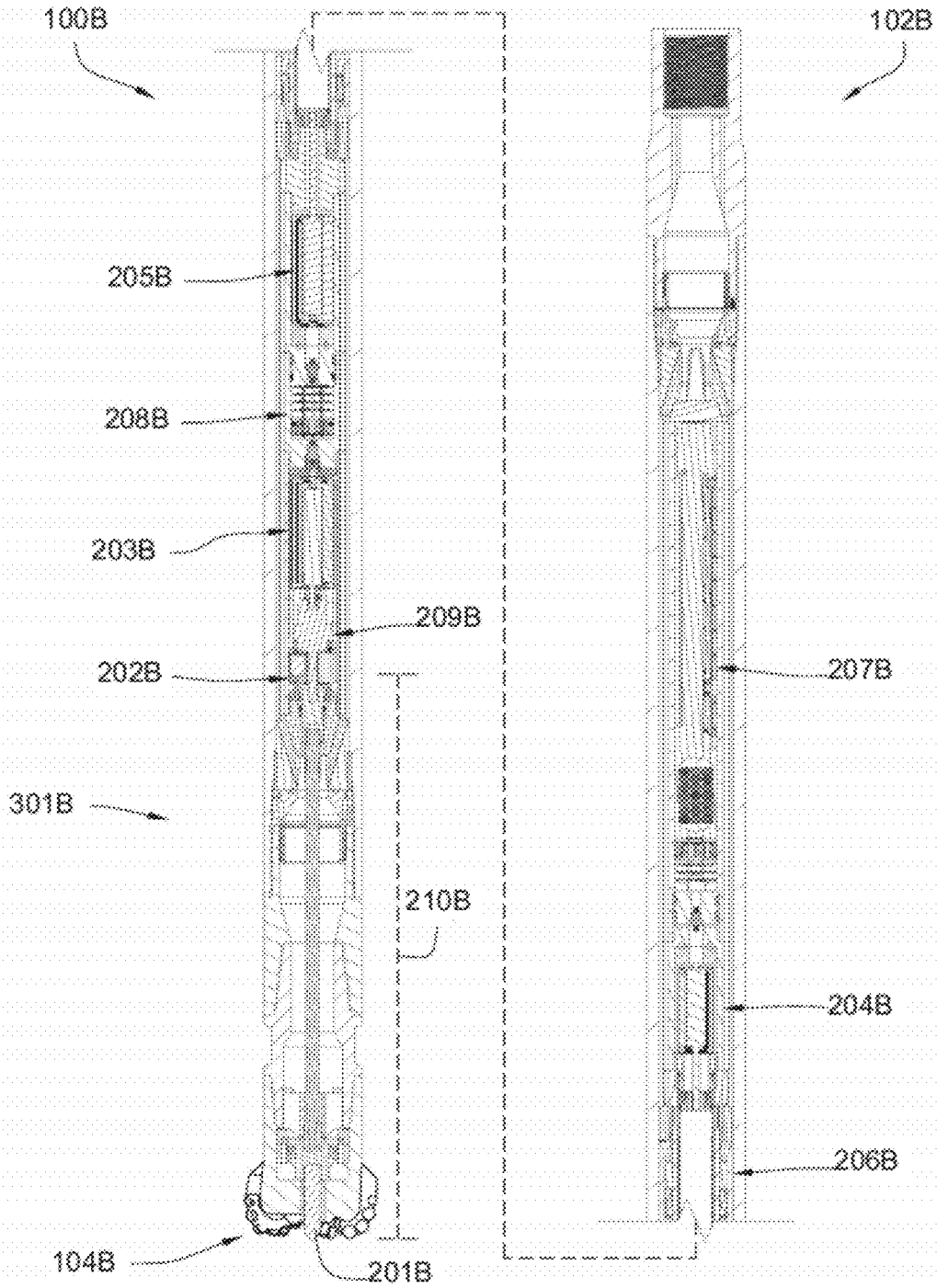
FIG. 2 is a cross-sectional diagram of bottom-hole assembly attached to the lower end of a drill string.

Referring now to FIG. 2, a cross-sectional diagram of drill string 100B discloses a bottom-hole assembly (BHA) 102B. The drill bit 104B may be part of the BHA 102B and comprises a jack element 201B positioned within a bit bore formed within the bit body. The jack element 201B may oscillate towards and away from the formation (not shown) along a bit axis of the bit bore, and the jack element 201B may also rotate around the bit axis.

The drill string comprises at least one position feedback sensor 202B that is adapted to detect an axial position and/or angular position or orientation of the jack element 201B. Monitoring the axial and angular positions of the jack element 201B may aid in steering the drill string 100B.

Rotation of the jack element 201B may be powered by a driving mechanism, such as a downhole motor 203B. The downhole motor 203B may be an electric motor, a mud motor, or combinations thereof. In the present embodiment, drill string 100B comprises an upper generator 204B and a lower generator 205B. Both generators 204B, 205B are powered by the flow of drilling mud (not shown) past one or more turbines 206B disposed intermediate the two generators 204B, 205B. In some embodiments only one generator may be used, or another method of powering the motor 203B may be employed.

The upper generator 204B may provide electricity to a direction and inclination (D&I) package 207B. D&I package 207B may monitor the orientation of the BHA 102B with respect to some relatively constant object, such as the center of the planet, the moon, the surface of the planet, a satellite, or combinations thereof. The lower generator 205B may provide electrical power to a computational board 208B and to the motor 203B. The computational board 208B may control steering and/or motor functions. The computational board 208B may receive drill string orientation information from the D&I package 207B and may alter the speed or direction of the motor 203B.

In the present embodiment a jack assembly 301B is disposed in a terminal region 210B of the drill string 100B and may be adapted to rotate with respect to the drill string 100B while the motor 203B may be rotationally fixed to the drill string 100B. In some embodiments one or more of the motor 203B, generators 204B, 205B, computational board 208B, D&I package 207B, or some other electrical component, may be rotationally isolated from the drill string 100B.

In the present embodiment the motor 203B connects to the jack element 201B via a geartrain 209B. The geartrain 209B may couple rotation of the motor 203B to rotation of the jack element 201B at a ratio of 25 rotations to 1 rotation and may itself be rotationally fixed to the drill string 100B. In some embodiments a different ratio may be used. The geartrain 209B and the jack element 201B may be part of the jack assembly 301B.

Figure 3:
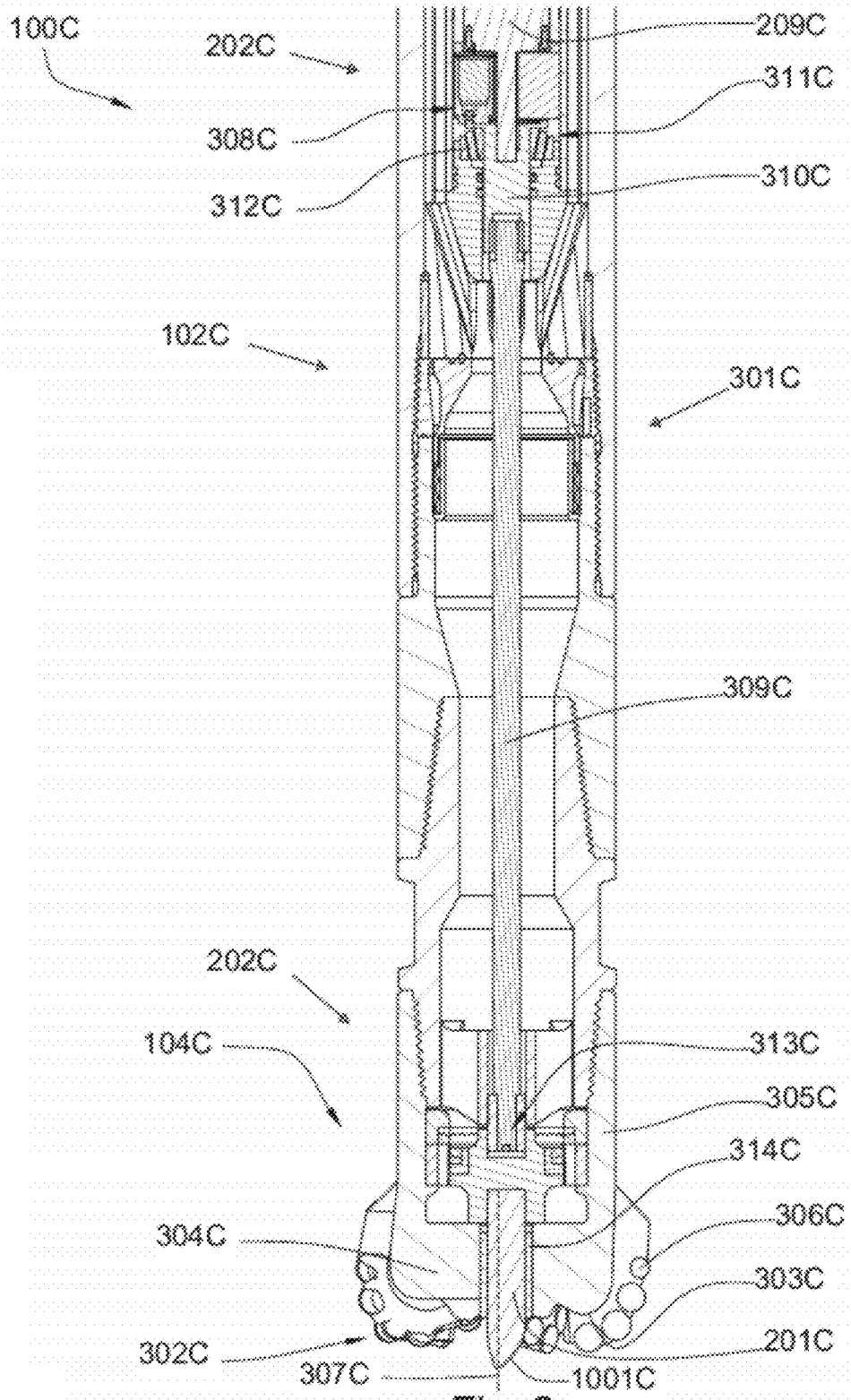
FIG. 3 is a cross-sectional diagram of an embodiment of a jack assembly.

FIG. 3 discloses a cross-sectional diagram of an embodiment of a jack assembly 301C. The jack assembly 301C is disposed within the drill string 100C and may be disposed with the BHA 102C. The jack element 201C is disposed on a distal end 302C of jack assembly 301C, substantially protrudes from a working face 303C of the drill bit 104C, and is adapted to move with respect to a bit body 304C of the bit 104C. The bit body 304C is disposed intermediate a shank 305C and the working face 303C. The working face 303C comprises at least one cutting element 306C. In the present embodiment the working face comprises a plurality of cutting elements 306C. The drill bit 104C may advance the drill string 100C further into the formation (not shown) by rotating, thereby allowing the cutting elements 306C to dig into and degrade the formation. The jack element 201C may assist in advancing the drill string 100C further into the formation by oscillating back and forth with respect to the formation.

In the present embodiment the jack element 201C comprises a primary deflecting surface 1001C disposed on a working tip at the distal end of the jack element 201C. The deflecting surface 1001C may form an angle relative to a central axis 307C of the jack element 201C of 15 to 75 degrees. The angle may create a directional bias in the jack element 201C. The deflecting surface 1001C of the jack element 201C may cause the drill bit 104C to drill substantially in a direction indicated by the directional bias of the jack element 201C. By controlling the orientation of the deflecting surface 1001C in relation to the drill bit 104C or to some fixed object the direction of drilling may be controlled. In some drilling applications, the drill bit, when desired, may drill 6 to 20 degrees per 100 feet drilled. In some embodiments, the jack element 201C may be used to steer the drill string 104C in a straight trajectory if the formation comprises characteristics that tend to steer the drill string 104C in an opposing direction.

The primary deflecting surface 1001C may comprise a surface area of 0.5 to 4 square inches. The primary surface 1001C may have a radius of curvature of 0.75 to 1.25 inches. The jack element 201C may have a diameter of 0.5 to 1 inch, and may comprise carbide. The distal end of the jack element 201C may have rounded edges so that stresses exerted on the distal end may be efficiently distributed rather than being concentrated on corners and edges.

The jack element 201C may be supported by a bushing 314C and/or bearing and may be in communication with at least one bearing. The bushing 314C may be placed between the jack element 201C and the drill string 100C in order to allow for low-friction rotation of the jack element 201C with respect to the drill string 100C. The bushing 314C may be beneficial in allowing the jack element 201C to be rotationally isolated from the drill string 100C. Thus, during a drilling operation, the jack element 201C may steer the drill string 100C as the drill string 100C rotates around the jack element 201C. The jack element 201C may be driven by the motor 203C to rotate in a direction opposite the drill string 100C.

In the present embodiment two position feedback sensors 202C are disposed proximate the jack assembly 301C. A first or rotational position sensor 308C is disposed proximate a coupler 310C on a geartrain side 311C of the coupler 310C. A driving shaft 309C may rotationally couple the jack element 201C to the coupler 310C and may be disposed intermediate the motor (not shown) and the jack element 201C. The coupler 310C may connect the geartrain 209C that is disposed intermediate the motor and the driving shaft 309 to the driving shaft 309. A bearing 312C facilitates rotation of the coupler 310C with respect to the drill string 100C.

A second or axial position sensor 313C may be disposed proximate the jack element 201C in the driving shaft 309C. Both the first rotational position sensor 308C and the second axial position sensor 313C may include various embodiments of the position feedback sensors 202C. In some embodiments a plurality of position feedback sensors disposed proximate the jack assembly 301C may all be first rotational position sensors 308C, or they may all be second axial position sensors 313C. In other embodiments a drill string 100C may comprise no more than one position feedback sensor 202C.

Figure 4:
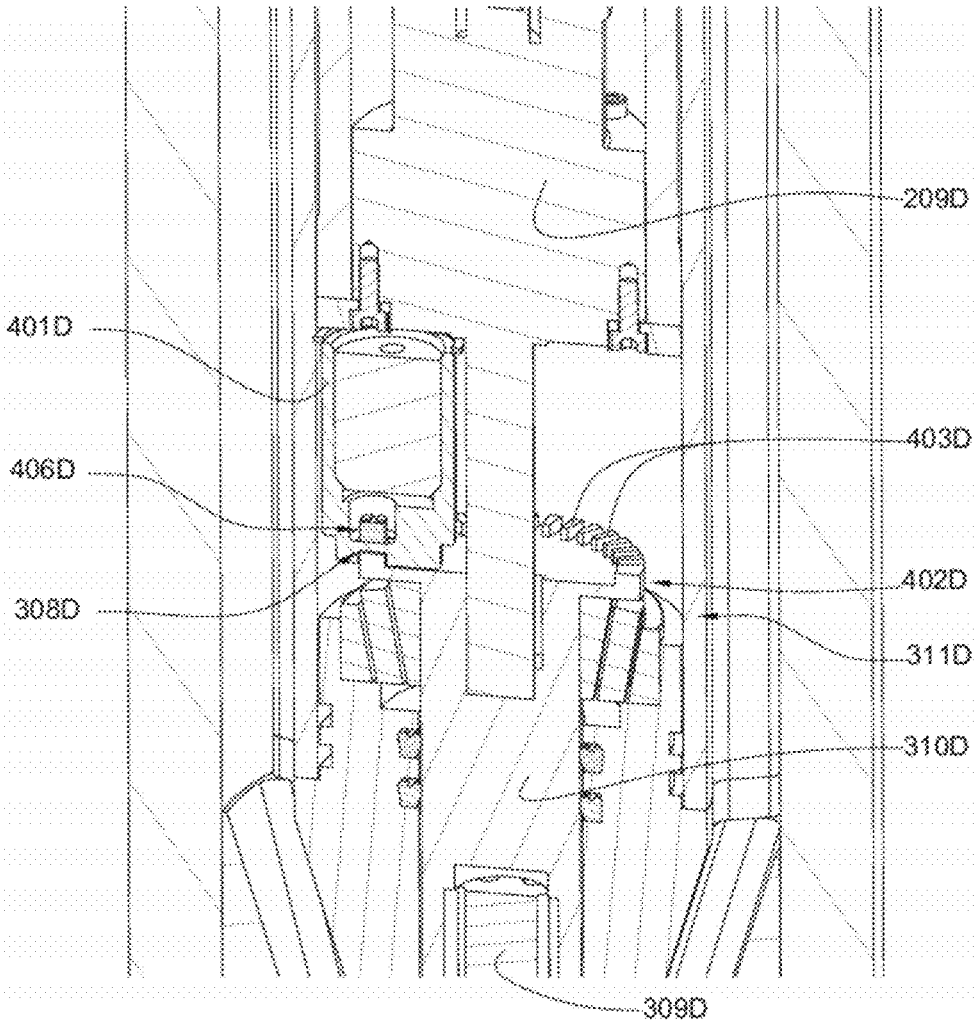
FIG. 4 is a cross-sectional diagram of an embodiment of a portion of a jack assembly.

FIG. 4 discloses a closer cross-sectional view of an embodiment of a first or rotational position sensor 308D, which can include a signal element 402D associated with the jack element being located in close proximity with a transducer element 406D associated with the drill string, with the BHA or with the bit body. The transducer element 406D of the rotational position sensor 308D is disposed within a pressure vessel 401D that is located proximate the geartrain 209D and the coupler 310D. The pressure vessel 401D may prevent drilling mud or other debris from contacting the transducer 406D.

The coupler 310D includes the signal element 402D that is disposed on the geartrain side 311D of the coupler 310D. In the present embodiment the signal element 402D comprises a generally disc-shaped geometry as well as a plurality of protrusions 403D disposed generally along a perimeter of the element 402D. Each protrusion 403D comprises a ferromagnetic material. In the present embodiment the signal element 402D is mechanically coupled to the jack element (not shown) via the coupler 310D and the driving shaft 309D.

The transducer element 406D of the rotational position sensor 308D illustrated in FIG. 4 is adapted to detect the presence of a ferromagnetic protrusion 403D. In some embodiments the transducer element 406D may also be adapted to detect the absence of a ferromagnetic protrusion 403D. In the current embodiment the rotational position sensor 308D comprises at least one hall-effect sensor.

Hall-effect sensors are known to detect the presence of ferromagnetic material in close proximity to the sensor by applying a magnetic flux to a conductor that is also carrying an electrical current. It is believed that applying the magnetic flux in a direction perpendicular to the direction of travel of the electrical current causes an electrical potential difference across the conductor. This electrical potential difference can be detected and thereby signal the close proximity of the ferromagnetic material to the hall-effect sensor. In some embodiments close proximity may be defined as within 6 mm. Close proximity may alternatively be defined as within 2.8 mm. Other embodiments of hall-effect sensors may also be consistent with the present invention. Additionally, in some embodiments the rotational position sensor 308D may comprise one or more hall-effect sensors, optical encoders, magnets, mechanical switches, rotary switches, resolvers, or combinations thereof.

By counting the number of protrusions that pass by the transducer element 406D in a given amount of time the differential velocity of the signal element 402D may be detected. The rotational velocity of the signal element 402D may correspond directly to the rotational velocity of the coupler 310D/driving shaft 309D/jack element in a fixed ratio, thereby allowing the velocity of the jack element to be determined. Preferably, the rotational velocity of the coupler 310D/driving shaft 309D and the signal element 204D may be between 60 and 160 rotations per minute (rpm).

In some embodiments the rotational position sensor 308D may be powered by a downhole source, such as a battery or generator. In other embodiments the sensor 308D may receive electrical power originating from the surface. The rotational position sensor 308D may be in electrical communication with a downhole network. The downhole network may transmit a signal from the sensor 308D to the computational board, thereby allowing the computation board to react to the signal by altering or maintaining some characteristic of the drilling operation.

In some embodiments a single rotational position feedback sensor 308D may comprise a plurality of hall-effect sensors. In an embodiment of a rotational position sensor 308D comprising three hall-effect sensors, the sensor 308D may be able to determine the direction in which a signal element 402D is rotating by monitoring which hall-effect sensor first detects a given ferromagnetic protrusion 403D. An example of such a rotational position sensor 308D is the Differential Speed and Direction Sensor model AT5651LSH made by Allegro Micro Systems, Inc., of Worcester, Mass. An example of a rotational position sensor 308D comprising one hall-effect sensor is the Unipolar Hall-Effect Switch model A1145LUA-T, also made by Allegro MicroSystems, Inc.

Figure 5:
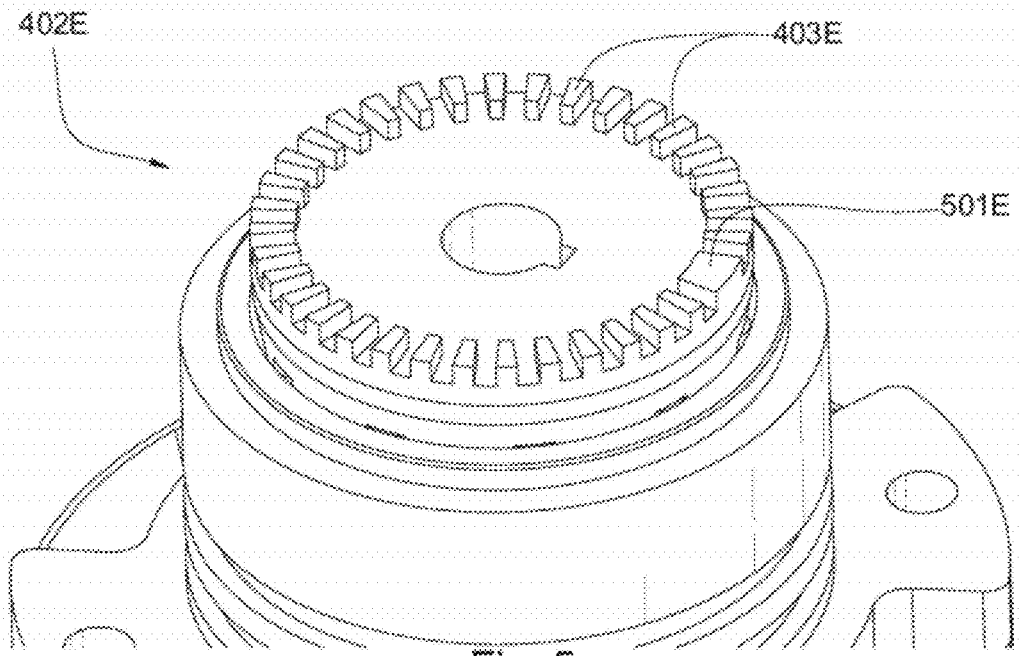
FIG. 5 is a perspective diagram of an embodiment of a portion of a jack assembly.

Referring now to FIGS. 5-8, various embodiments of signal elements for the rotational position sensor are disclosed. FIG. 5 discloses a perspective view of an embodiment of a signal element 402E that includes a reference point 501E. In FIG. 5 the reference point 501E is a protrusion 403E that is larger than the majority of the protrusions 403E. This is believed to create a longer signal from the rotational position sensor. Having a detectable reference point 501E built into the signal element 402E is believed to allow for corrections to be made on velocity and position calculations should one or more protrusions 403E fail to activate the rotational position sensor. Furthermore, by counting how many protrusions 403E have been detected past the reference point 501E in a given direction, the angular position or orientation of the reference point 501E in relation to the sensor may be determined.

In some embodiments the reference point 501E may be a plurality of closely spaced elements that are detectable by the transducer element of the rotational position sensor (not shown), or an extended absence of detectable signal elements.

In embodiments where the reference point 501E maintains a fixed orientation with the jack element, the angular position or orientation of the jack element with respect to the rotational position feed sensor, which is associated with the drill string, with the BHA or with the bit body, may be determined. In some embodiments the orientation of the jack element with respect to the sensor may correspond to the jack element's orientation with respect to the center of the planet, the surface of the ground, to some heavenly body, satellite, or to some other frame of reference important to drilling operations.

Figure 6:
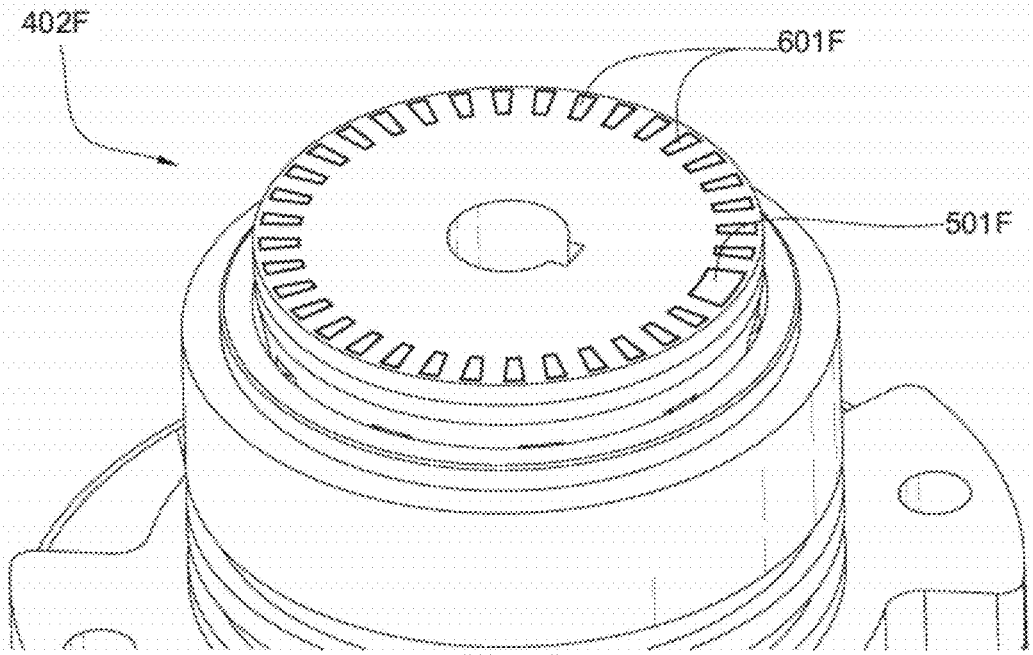
FIG. 6 is a perspective diagram of another embodiment of a portion of a jack assembly.

Referring now to FIG. 6, another embodiment of a signal element 402F is disclosed comprising a plurality of inserts 601F disposed along an outer perimeter of the signal element 402F. The inserts 601F may comprise a characteristic that differs from the rest of the signal element 402F in density, geometry, length, chemical composition, magnetism, conductivity, optical reactivity, or combinations thereof. The transducer element of the rotational position sensor may be adapted to detect a change in these characteristics on the signal element 402F. In some embodiments, the inserts 601F may differ from each other in a detectable characteristic so that the absolute angular position or orientation of the signal element 402F can be determined by detecting any given insert 601F.

Figure 7:
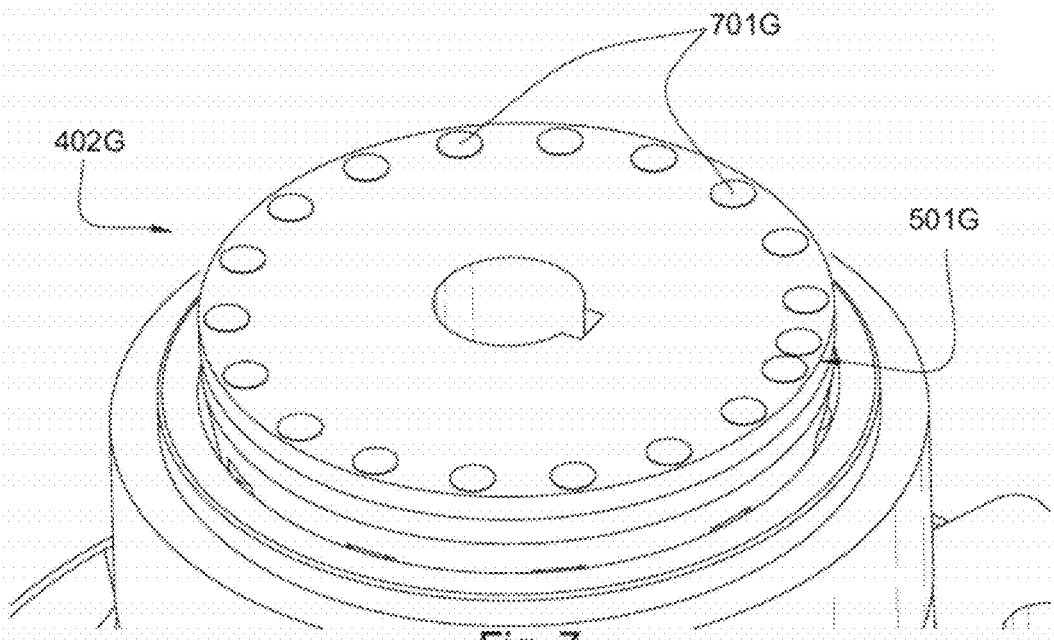
FIG. 7 is a perspective diagram of another embodiment of a portion of a jack assembly.

FIG. 7 discloses an embodiment of a signal element 402G comprising a plurality of coated regions 701G. The coated regions 701G may affect a change in the characteristics of the signal element 402G perceived by rotational position sensor. The characteristic may include those noted above in the description of FIG. 6.

Figure 8:
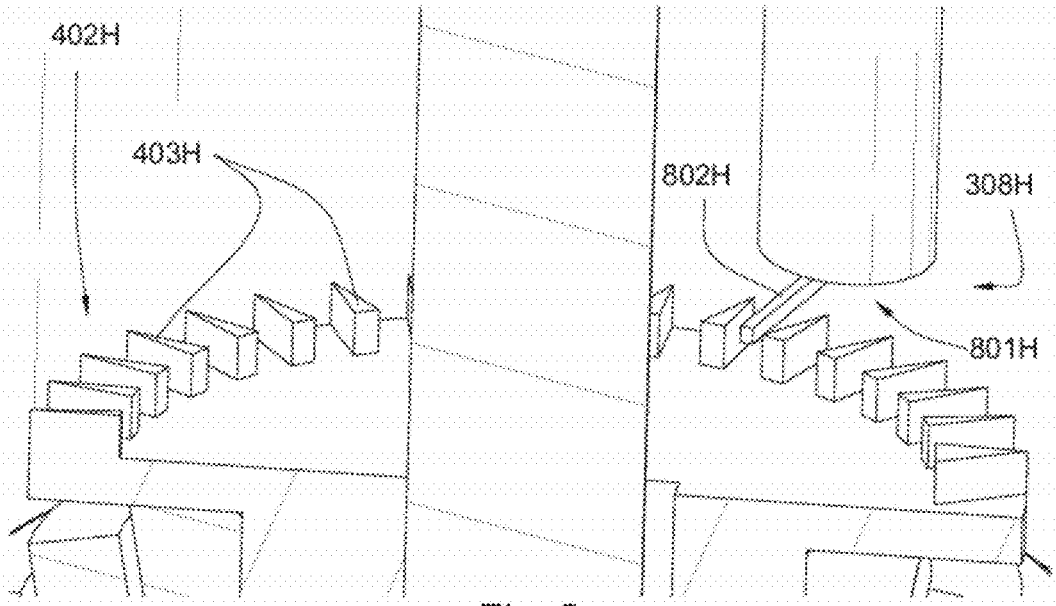
FIG. 8 is a cross-sectional diagram of another embodiment of a portion of a jack assembly.

FIG. 8 discloses an embodiment of a rotational position sensor comprising a mechanical switch 801H. The mechanical switch 801H is disposed proximate the signal element 402H and is rotatably isolated from the signal element 402H. In the present embodiment the signal element 402H is adapted to rotate about a central axis. The signal element 402H comprises a plurality of protrusions 403H that are disposed along the outer perimeter of the signal element 402H. The mechanical switch 801H may comprise an arm 802H. When the arm 802H contacts a protrusion 403H, an increase of strain in the arm 802H may result thereby inducing a signal. The arm 802H may be in communication with a strain gauge or it may be a smart material such as a piezoelectric or magnetostrictive material which may generate a signal under such a strain. In some embodiments, the protrusions 403H and arm 802H may complete an electric circuit when in contact with one another. It is believed that the arm 802H should comprise a certain degree of flexibility allowing the arm 802H to contact the protrusion 403H while allowing the arm 802H to slide past the protrusion 403H as the signal element 402H continues to rotate. In some embodiments the arm 802H may rotate about a central axis, or both the arm 802H and the signal element 402H may rotate about a central axis. Although specific rotational position sensors 308H and signal elements 402 have been disclosed, other position sensors, signal elements 402, and detectable signal element characteristics may be compatible with the present invention.

Figure 9:
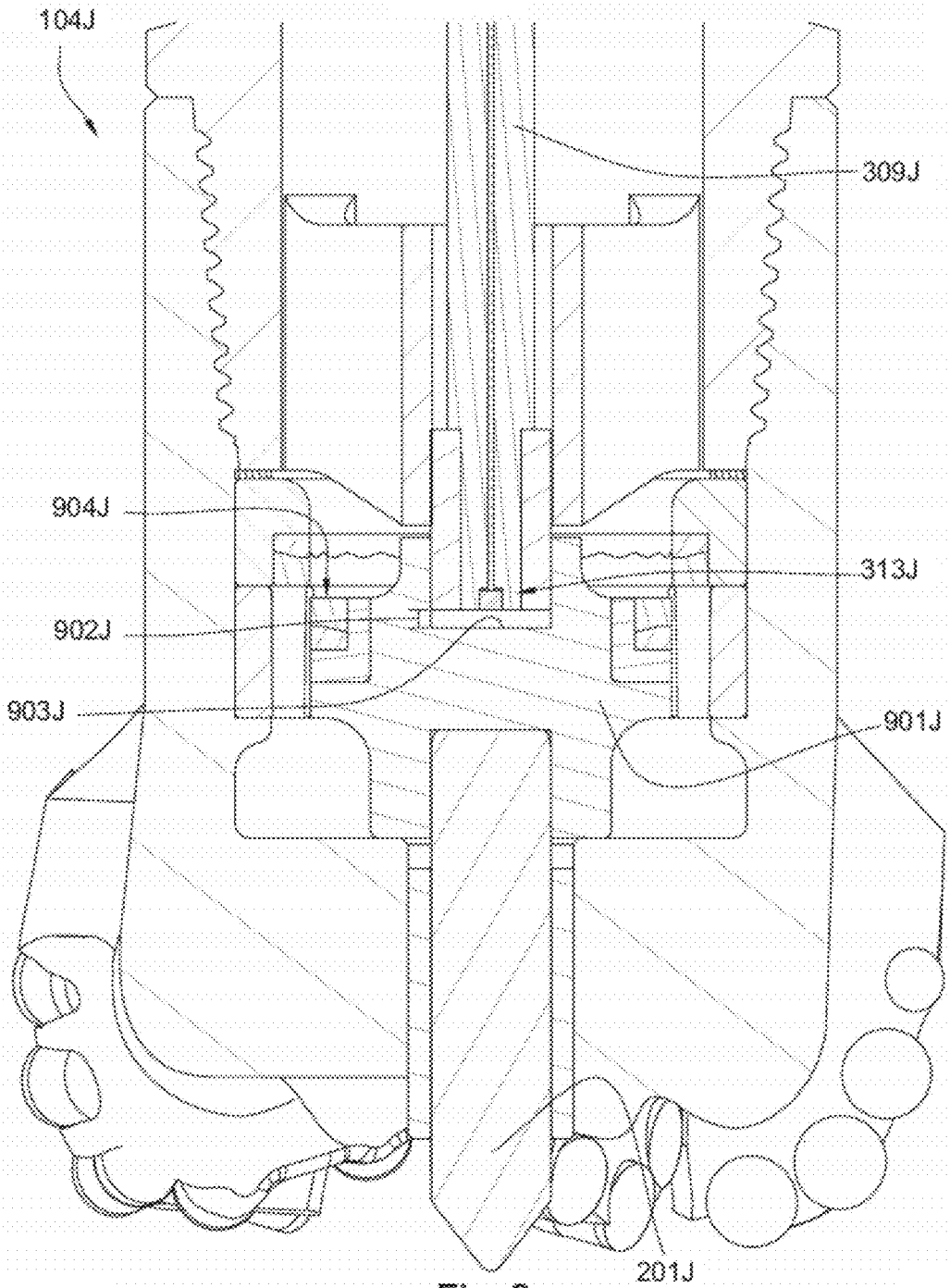
FIG. 9 is a cross-sectional diagram of another embodiment of a jack assembly.

Referring now to FIG. 9, an axial position sensor 313J is disposed proximate the jack element 201J protruding from the working face of the drill bit 104J. Specifically the sensor 313J is disposed within an end of the driving shaft 309J that is proximate the back end of the jack element 201J, which back end is opposite the working tip at the distal end of the jack element 201J. A support element 901J is disposed intermediate the back end of the jack element 201J and the driving shaft 309J. The support element 901J may be rotationally fixed to the jack element 201J and to the driving shaft 309J. The support element 901J may be adapted to oscillate back and forth in relation to the driving shaft 309J. This oscillation may be driven in one direction by the force of drilling mud impacting the support element 901J, and in the other direction by the impact of the jack element 201J with the formation. When the jack element 201J is fully extended drilling mud release valves 904J may be opened, thereby allowing the force of the jack element impacting the formation to drive the jack element 201J to a retracted position, which may automatically close the valves 904J.

In the present embodiment the axial position sensor 313J is a hall-effect sensor. In some embodiments the jack element 201J or the support element 901J may comprise a ferromagnetic material. A gap 902J between the sensor 313J and an inner surface 903J of the support element 901J may be greater than 6 mm when the jack element 201J is fully extended into the formation. The gap 902J may be less than 2.8 mm when the jack element is fully retracted from the formation. When the gap 902J is less than 2.8 mm the sensor 313J may signal the computational board. The amount of time between signals may indicate an oscillation frequency of the jack element 201J. It is believed that the jack oscillation frequency may be indicative of a formation characteristic, such as formation hardness.

Figure 10:
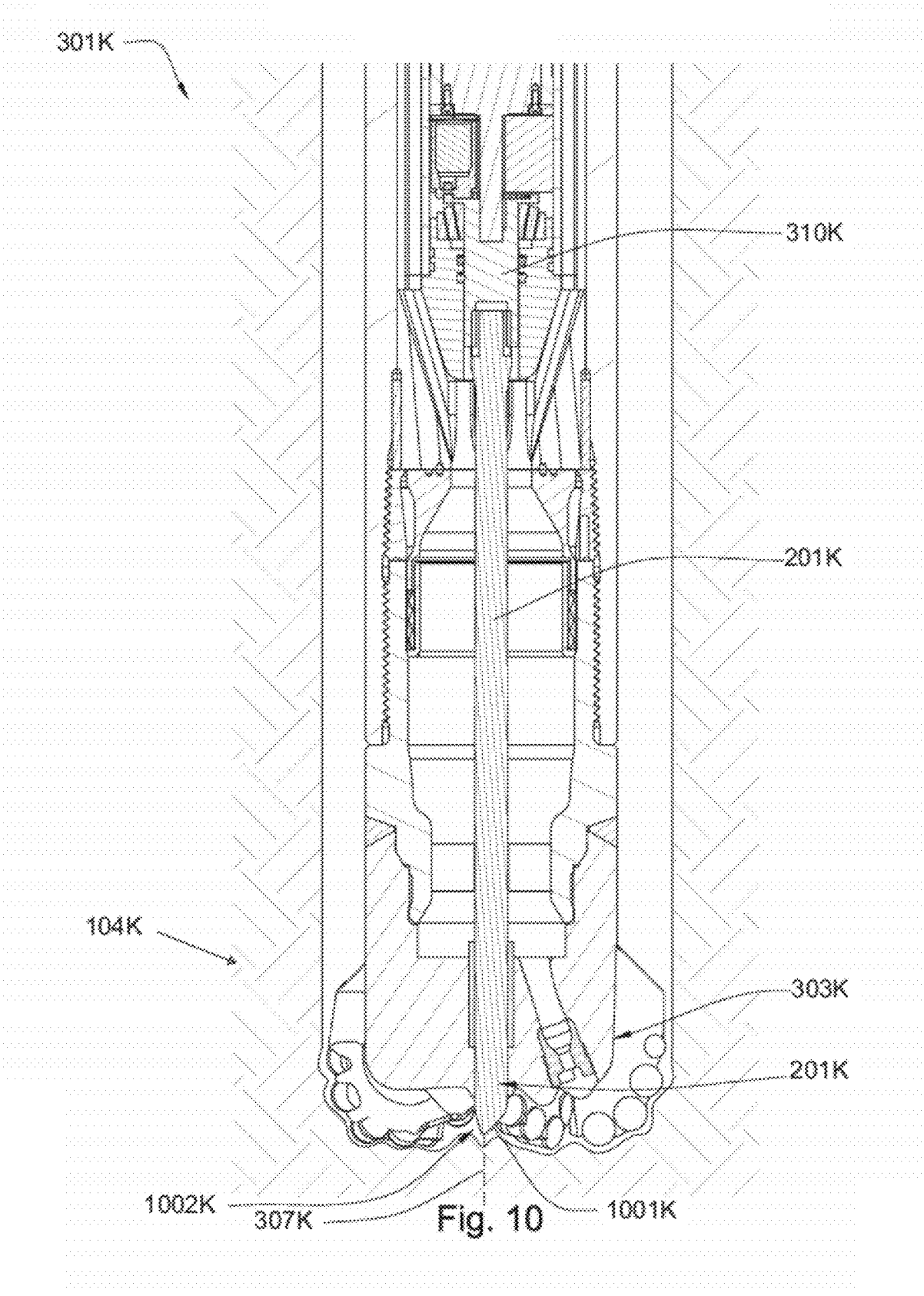
FIG. 10 a cross-sectional diagram of another embodiment of a jack assembly.

FIG. 10 discloses a jack assembly 301K having a jack element 201K that extends from the working face 303K all the way to the coupler 310K. FIG. 10 discloses the long jack element 201K in conjunction with the primary deflecting surface 1001K located on a distal end 1002K of the jack element 201K. The jack element 201K may be adapted to rotate about central axis 307K, and may or may not be adapted to oscillate with respect to the drill bit 104K.

Figure 11:
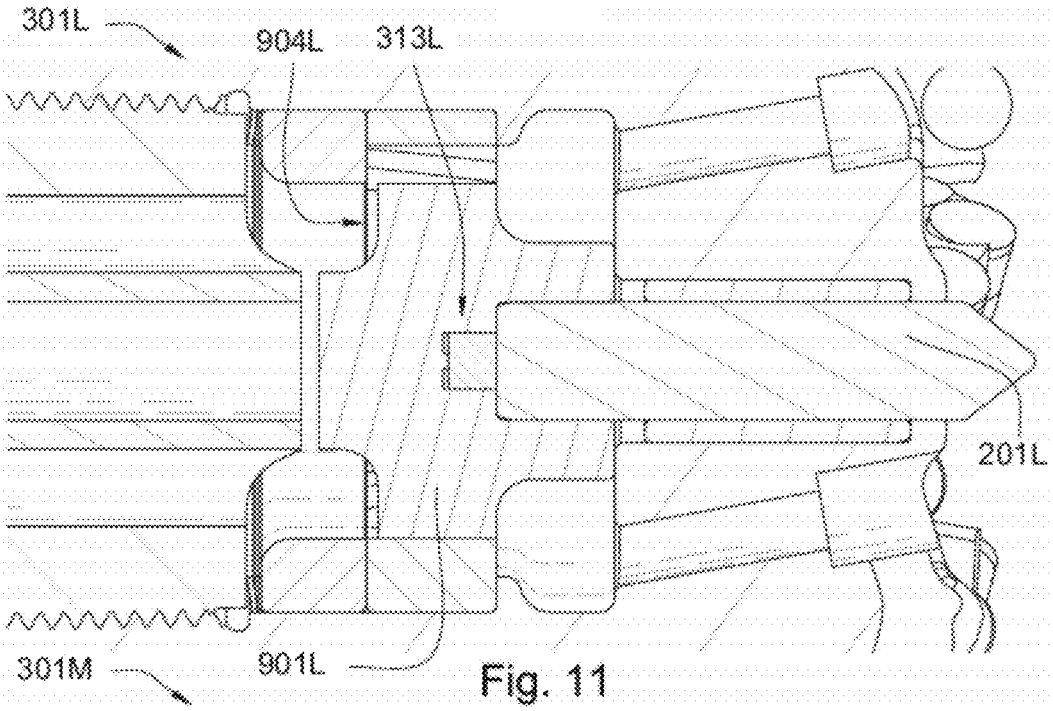
FIG. 11 is a cross-sectional diagram of another embodiment of a jack assembly.
Figure 12:
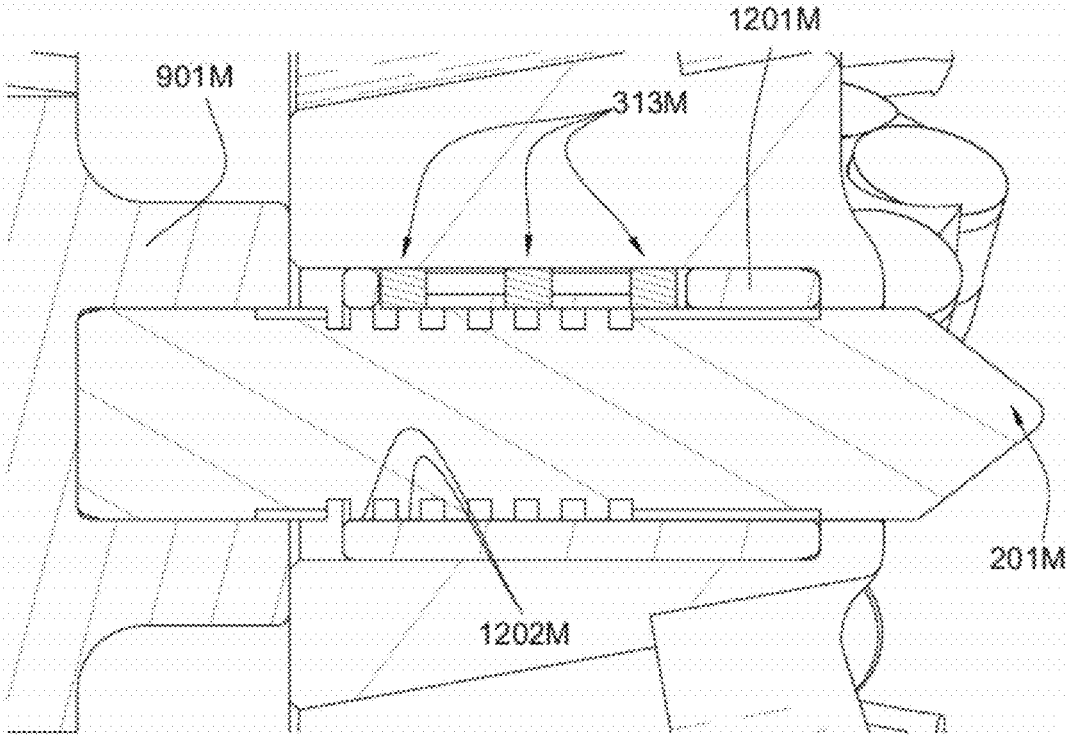
FIG. 12 is a cross-sectional diagram of another embodiment of a jack assembly.

FIGS. 11 and 12 disclose alternate embodiments of support element wherein the support element is translationally independent of any driving shaft disposed within the jack assembly. FIGS. 11 and 12 also disclose embodiments of position feedback sensors disposed proximate the jack element. In FIG. 11, for example, the axial position sensor 313L is disposed intermediate the support element 901L and the jack element 201L and is rotationally associated with the jack element 202L. In the embodiment of FIG. 11, the axial position sensor 313L may comprise an accelerometer.

Referring now to FIG. 12, a plurality of axial position sensors 313M are disposed in a bushing 1201M proximate the jack element 201M. The jack element 201M may comprise a plurality of recesses 1202M separated by a ferromagnetic material and disposed proximate the sensors 202M. The sensors 202M may comprise hall-effect sensors that may sense the presence or absence of the recesses 1202M. It is believed that this embodiment may allow for the measurement of not only the frequency of jack oscillation to be detected, but also as to whether the jack element 201M is fully retracted or fully extended.

Figure 13:
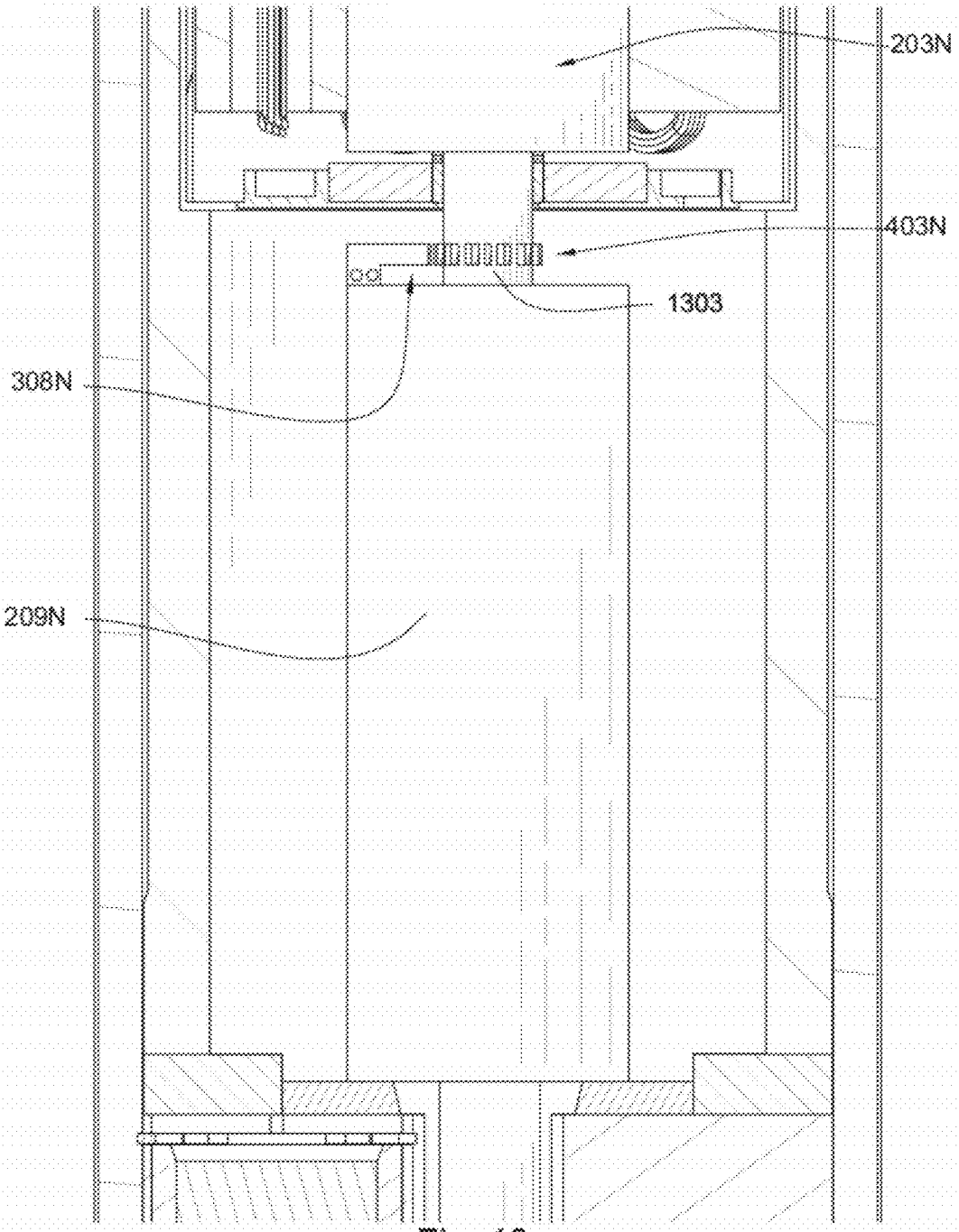
FIG. 13 is a cross-sectional diagram of an embodiment of a position feedback sensor disposed in an embodiment of a geartrain.

Referring now to FIG. 13, an embodiment is disclosed in which a rotational position sensor 308N is disposed proximate the geartrain 209N. In the present embodiment the sensor 308N is disposed proximate an extension 1303 of the motor 203N that protrudes into the geartrain. The extension 1303 comprises protrusions 403N that may be recognized by the rotational position sensor 308N, thereby indicating the velocity of rotation of the extension 1303. The velocity of rotation of extension 1303 may directly correlate to the velocity of rotation of the jack element in a ratio of 25:1. In some embodiments of the invention one or more sensors 308N may be disposed in other areas within the geartrain 209N.

Figure 14:
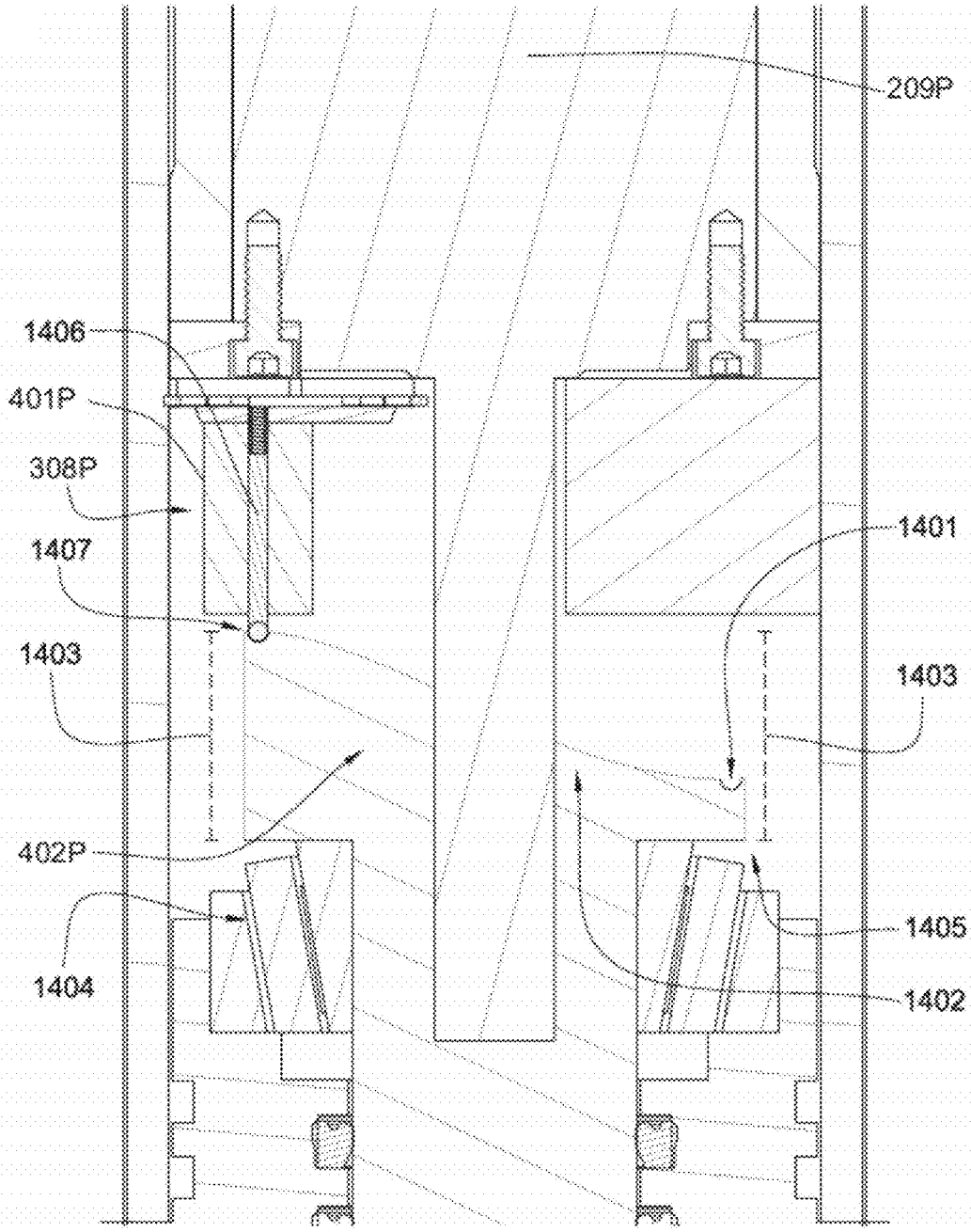
FIG. 14 is a cross-sectional diagram of another embodiment of a position feedback sensor and a signal element.

Referring now to FIG. 14, another embodiment of a signal element 402P is disclosed. FIG. 14 discloses a cross-sectional view of a signal element 402P connected to the geartrain 209P and disposed proximate an embodiment of a rotational position sensor 308P. In this embodiment the signal element 402P comprises a generally circular base and a tapered profile 1402. The signal element 402P may comprise an element height 1403 that is longer at a first end 1404 than the height at a second end 1405. The rotational position sensor 308P may comprise a probe 1406 that retractably extends from the pressure vessel 401P.

In FIG. 14 the probe 1406 is spring loaded and the spring tension may be monitored to determine how far the probe is extended. In other embodiments the probe 1406 may comprise a compressed gas and a pressure sensing device (not shown). The probe 1406 may comprise a generally spherical tip 1407 that may be adapted to rotate about any axis that runs through a center of the spherical tip 1407. As the signal element 402P rotates about a central axis the probe 1406 may retract or extend depending on the height 1403 of the signal element 402P at that particular position. FIG. 14 also discloses a guide track 1401 disposed around a perimeter of the signal element 402P. The spherical tip 1407 of the probe 1406 may fit into the guide track 1401 and may follow the guide track 1401 around the perimeter of the signal element 402P.

Whereas the present invention has been described in particular relation to the drawings attached hereto, it should be understood that other and further modifications apart from those shown or suggested herein, may be made within the scope and spirit of the present invention.

What is claimed is:

1. A directional drilling apparatus for mechanical association with a drill string positioned in a wellbore, comprising:

a drill bit attachable to the drilling string, the drill bit being rotatable in a first direction of rotation with respect to the wellbore, the drill bit including:

a shank having a first end, a second end spaced from the first end, and a shank bore extending from the first end to the second end, and a bit body having a working end and a top end spaced from the working end, the top end being attached to the first end of the shank, the bit body having a working face at the working end, the bit body having at least one cutting element affixed to the working face, the bit body having a bit bore extending from the working end to the top end and located to register with the shank bore, the bit bore having a bit axis;

a jack element disposed within the bit bore, the jack element having a working tip substantially protruding from the working face and a back end spaced from the working tip and positioned proximate the shank bore, the jack element being rotatable with respect to the bit body from a first angular position to a second angular position, the jack element being movable along the bit axis with respect to the working face from a first axial position to a second axial position;

a rotational position sensor associated with the bit body and adapted to detect an angular position of the jack element with respect to the bit body and to generate and supply angular position signals reflective of the angular position;

an axial position sensor associated with said bit body to measure said axial position of said jack element with respect to said working face and to generate and supply and axial position signals reflective of said axial position;

a motor mechanically associated with the drill string and connected to the jack element, the motor being operable to rotate the jack element; and a computational device connected to receive and process the angular position signals and to supply control signals to the motor to cause the motor to rotate the jack element from the first angular position toward the second angular position in a second direction of rotation opposite the first direction of rotation.

2. The drilling apparatus of claim 1, wherein the motor is powered by a downhole power source.

3. The drilling apparatus of claim 1, wherein the computational device is in electrical communication with a downhole network.

4. The drilling apparatus of claim 1, wherein the rotational position sensor is part of a bottom hole assembly.

5. The drilling apparatus of claim 1, wherein the rotational position sensor is selected from the group consisting of a hall effect sensor, an optical encoder, a magnet, a mechanical switch, a rotary switch, a resolver, and an accelerometer.

6. The drilling apparatus of claim 1, wherein the rotational position sensor includes a signal element associated with the jack element being disposed proximate a transducer associated with the bit body.

7. The drilling apparatus of claim 6, wherein the signal element comprises a generally disc-shaped geometry.

8. The drilling apparatus of claim 1, wherein the working tip of the jack element comprises a distal deflecting surface having an angle relative to a central axis of 15 to 75 degrees to provide a directional bias for directional drilling.

9. The drilling apparatus of claim 1, wherein the computational device is rotationally fixed to the drill string.

10. The drilling apparatus of claim 1, further comprising a driving shaft supporting the jack element, the driving shaft being at least partially located within the shank bore, the driving shaft having a lower end connected to the back end and an upper end connected to the motor.

11. The drilling apparatus of claim 10, further comprising a geartrain positioned between the motor and the upper end of the driving shaft.

12. Drilling apparatus for directional drilling, comprising:

a drill string for placement in a wellbore of a well, said drill string having a drilling end when positioned in said wellbore;

a drill bit attachable to said drilling end, said drill bit being rotatable in a first direction of rotation with respect to said wellbore, said drill bit including:

a shank having a first end, a second end spaced from said first end, and a shank bore extending from said first end to said second end, and a bit body having a working end and a top end spaced from said working end, said top end being attached to said first end of said shank, said bit body having a working face at said working end, said bit body having at least one cutting element affixed to said working face, said bit body having a bit bore extending from said working end to said top end and located to register with said shank bore, said bit bore having an axis;

a jack element positioned within said bit bore, said jack element having a working tip positioned to extend outwardly from said working face and a back end spaced from said working tip and positioned proximate said shank bore, said jack element being rotatable with respect to said bit body from a first angular position to a second angular position, said jack element being movable with respect to said bit body along said axis of said bit bore from a first axial position to a second axial position;

a rotational position sensor associated with said bit body to measure said angular position of said jack element with respect to said bit body and to generate and supply angular position signals reflective of said angular position;

an axial position sensor associated with said bit body to measure said axial position of said jack element with respect to said bit body and to generate and supply axial position signals reflective of said axial position;

a motor associated with said drill string and connected to said jack element, said motor being operable to rotate said jack element; and a computational device connected to receive and process said angular position signals and to supply control signals to said motor to cause said motor to rotate said jack element from said first angular position toward said second angular position in a second direction of rotation opposite said first direction of rotation.

13. The drill string of claim 12, wherein said computational device is operable to supply said control signals to said motor to cause said motor to continuously rotate said jack element and maintain said jack element in at a predetermined angular position with respect to said wellbore.

14. The drill string of claim 12, further comprising a driving shaft supporting said jack element, said driving shaft being at least partially located within said shank bore, said driving shaft having a lower end connected to said back end and an upper end connected to said motor.

15. The drill string of claim 14, further comprising a geartrain positioned between said upper end and said motor.

16. A directionally-steerable drill string, said drill string comprising:

a drill string for placement in a wellbore of a well, said drill string having a drilling end when positioned in said wellbore;

a drill bit attachable to said drilling end, said drill bit being rotatable in a first direction of rotation with respect to said wellbore, said drill bit including:

a shank having a first end, a second end spaced from said first end, and a shank bore extending from said first end to said second end, and a bit body having a working end and a top end spaced from said working end, said top end being attached to said first end of said shank, said bit body having a working face at said working end, said bit body having at least one cutting element affixed to said working face, said bit body having a bit bore extending from said working end to said top end and located to register with said shank bore, said bit bore having a bit axis;

a jack element positioned within said bit bore, said jack element having a working tip positioned to extend outwardly from said working face and a back end spaced from said working tip and positioned proximate said shank bore, said jack element being movable along said bit axis with respect to said working face from a first axial position to a second axial position;

an axial position sensor associated with said bit body to measure said axial position of said jack element with respect to said working face and to generate and supply axial position signals reflective of said axial position; and a computational device connected to receive and process said axial position signals and to monitor said axial position of said jack element.

17. The drill string of claim 16, comprising said jack element being rotatable with respect to said bit body from a first angular position to a second angular position.

18. The drill string of claim 17, further comprising a rotational position sensor associated with said bit body to measure said angular position of said jack element with respect to said bit body and to generate and supply angular position signals reflective of said angular position.

19. The drill string of claim 18, further comprising:

a motor associated with said drill string and connected to said jack element, said motor being operable to rotate said jack element; and said computational device being connected to receive and process said angular position signals and to supply control signals to said motor to cause said motor to rotate said jack element from said first angular position toward said second angular position in a second direction of rotation opposite said first direction of rotation.

20. The drill string of claim 19, further comprising a drive shaft for supporting said jack element, said drive shaft being at least partially located within said shank bore, said drive shaft having a lower end connectable to said back end, said drive shaft having an upper end mechanically associated with said motor.

21. The drill string of claim 20, further comprising a geartrain disposed between said upper end and said motor.

* * * * *